United States Patent [19]

Iwako et al.

[11] Patent Number: 4,691,867

[45] Date of Patent: Sep. 8, 1987

[54] METHOD AND APPARATUS FOR CONTINUOUSLY MIXING AND KNEADING PULVERULENT BODIES SUCH AS PULVERIZED COAL, OIL COKE TO PREPARE SLURRY THEREOF

[75] Inventors: Motonari Iwako; Masaaki Nakao, both of Tokyo, Japan

[73] Assignee: Kabushiki Kaisha Hunken, Tokyo, Japan

[21] Appl. No.: 821,917

[22] Filed: Jan. 21, 1986

[51] Int. Cl.[4] ..... B02C 23/40

[52] U.S. Cl. ..... 241/21; 241/46.08; 241/101 B; 241/188 A

[58] Field of Search ..... 241/101 B, 21, 15, 29, 241/16, 188 R, 188 A, 261, 261.2, 98, 261.3, 41, 46.02, 42, 46.06, 162, 46.08, 154, 186.4; 44/51

[56] References Cited

U.S. PATENT DOCUMENTS 3,125,305 3/1964 Willems ..... 241/162 X

FOREIGN PATENT DOCUMENTS 1115689 3/1950 Japan .
11115616 12/1953 Japan .
22511 7/1973 Japan .
38828 10/1978 Japan .
32755 8/1980 Japan .
9844 2/1982 Japan .
450011 7/1936 United Kingdom ..... 241/162

*Primary Examiner*—Mark Rosenbaum

*Attorney, Agent, or Firm*—Wenderoth, Lind & Ponack

[57] ABSTRACT

A method of continuously mixing and kneading pulverulent bodies such as pulverized coal, oil coke to prepare a slurry thereof. Pulverulent bodies supplied continuously at a fixed rate from a supply tube are spattered and dispersed by a rotary mixing disk rotating in a mixing chamber covered with a base plate. A flow of a main liquid is directed as an annular overflow film downward along an overflow tube to the spattered and dispersed pulverulent bodies while a small amount of liquid such as additives is injected from a plurality of nozzles. The pulverulent bodies are uniformly humidified with a plurality of upper surface scrapers provided on the rotary mixing disk and disposed to cross the injection nozzle ports as the rotary mixing disk rotates and side face scrapers provided on the rotary mixing disk and turning along the inner wall of the mixing chamber. The pulverulent bodies are then collected to the center of the mixing chamber with a collecting blade, to be supplied to the next mixing and kneading chamber and dispersed centrifugally by a rotary mixing and kneading disk rotating in the mixing and kneading chamber while being mixed and kneaded by fixed mixing and kneading pins disposed on the upper wall of the mixing and kneading chamber and movable mixing and kneading pins planted in the rotary mixing and kneading disk. Finally, the mixed and kneaded pulverulent bodies are directed to a discharge port by a mixing and kneading type scraper blade provided on the rotary mixing and kneading disk.

4 Claims, 6 Drawing Figures

METHOD AND APPARATUS FOR CONTINUOUSLY MIXING AND KNEADING PULVERULENT BODIES SUCH AS PULVERIZED COAL, OIL COKE TO PREPARE SLURRY THEREOF

BACKGROUND OF THE INVENTION

1. Field of the Invention:

This invention relates to a method and apparatus for continuously mixing and kneading pulverulent bodies such as pulverlized coal, oil coke supplied continuously by a fixed quantity to prepare slurry thereof, and more particularly to, a method and apparatus for continuously mixing and kneading which can be mixing and kneading pulverulent bodies into the thixotropic state while humidifying them under the grain state (primary grain state).

2. Description of the Prior Art:

Conventionally, when pulverulent bodies supplied continuously are humidified, mixed and kneaded, it is an extremely important and difficult problem how to humidify uniformly the pulverulent bodies and through what mixing and kneading system they should be passed.

We previously proposed a continuously mixing method and an optimum apparatus for carrying out the method in which liquid is adapted to flow down as an annular overflow film and the pulverulent bodies supplied continuously by a fixed amount are dispersed and collide with the liquid while being mixed with the liquid with a rotary mixing disk (for example, Japanese Patent Publication Nos. Sho 48-22511, Sho 53-38828, sho 55-32755 and Sho 57-9844,). However, when the pulverulent bodies such as pulverlized coal, oil coke are made into a slurry, a mixing and kneading system must be ensured for more adequate mixing and kneading.

A prior general means for mixing and kneading the pulverulent bodies sufficiently comprises a humidifying means and a mixing and kneading means separated therefrom for repeatedly mixing and kneading with a plurality of mixing and kneading devices.

In said conventional means for repeating the mixing and kneading, a plurality of mixing and kneading devices are needed. Thus, the transfer speed of material between the devices is varied and the quality of the material is degraded so that the cost of equipment ot prevent the device from such variation and degradation is disadvantageously obliged to increase.

SUMMARY OF THE INVENTION

An object of the present invention is to provide a continuously mixing and kneading method and apparatus to carry out this method for preparing a slurry of pulverulent bodies such as pulverlized coal, oil coke in which prior defects are overcome and pulverulent bodies supplied continuously in a fixed amount (i.e. at a fixed rate) can be uniformly humidified in the grain state (primary grain state), collected in the swelling state and sent to a mixing and kneading system, in which time taken for passing the pulverulent bodies through the mixing and kneading system can be extended as long as possible to achieve sufficient mixing and kneading with a passing shearing force.

In the continuously mixing and kneading method according to the present invention for preparing a slurry of pulverulent bodies such as pulverlized coal, oil coke, the pulverulent bodies continuously supplied in a fixed amount from a supply tube 10 are spattered and dispersed by a rotary mixing disk 3 rotating in a mixing chamber 1 covered with a base plate 2. Main liquid is adapted to flow down as an annular outflow film along an outflow tube 25 of an inverse conical type with respect to these spattered and dispersed pulverulent bodies while a small amount of liquid such as an additive is jetted from a plurality of injection nozzles 4 to humidify the pulverulent bodies uniformly with a plurality of upper surface scrapers 5 provided on said rotary mixing disk 3 and disposed to cross the parts of said injection nozzle as said disk rotates and side face scrapers 7 provided on said rotary mixing disk 3 and turned along the inner wall of said mixing chamber. The pulverulent bodies are collected in the center with collecting blades 8 to be supplied to a next stage mixing and kneading chamber 6 and dispersed centrifugally with a rotary mixing and kneading disk 9 rotating in the mixing and kneading chamber 6, while being mixed and kneaded with fixed mixing and kneading pins 1 disposed on the upper wall of said mixing and kneading chamber 6 and movable mixing and kneading pins 12 planted in said rotary mixing and kneading disk 9 and discharged from a discharge port 14 with a mixing and kneading type scraper blade 13 provided on said rotary mixing and kneading disk 9.

Also, there is provided a continuously mixing and kneading apparatus which according to the present invention comprises the mixing chamber 1 covered with the base plate 2, the supply tube 10 connected to a fixed amount supply unit, for supplying continuously the pulverulent bodies in a fixed amount, the rotary mixing disk 3 disposed in the mixing chamber 1 for spattering and dispersing the pulverulent bodies supplied from the supply tube 10, the outflow tube 25 of inverse conical type disposed on the upper central portion of the mixing chamber for flowing down main liquid as an annular outflow film with respect to the spattered and dispersed pulverulent bodies, a plurality of injection nozzles 4 for injecting further a small amount of liquid such as additives with respect to said spattered and dispersed pulverulent bodies, a plurality of upper surface scrapers 5 provided on said rotary mixing disk 3 and arranged to cross said injection nozzle ports as the rotary mixing disk rotates, the side face scrapers 7 provided on said rotary mixing disk 3 to turn along the inner wall of said mixing chamber, the collecting blades 9 disposed on the bottom of said mixing chamber 1 to collect the pulverulent bodies in the center, the mixing and kneading chamber 6 provided on the next stage of said mixing chamber, the rotary mixing and kneading disk 9 disposed in the mixing and kneading chamber 6 to disperse centrifugally the pulverulent bodies humidified and supplied from said mixing chamber 1, the fixed mixing and kneading pins 11 secured to the upper wall of the mixing and kneading chamber 6, the movable mixing and kneading pins 12 planted in said rotary mixing and kneading disk 9 and the mixing and kneading type scraper blade 13 provided on said rotary mixing and kneading disk 9 to discharge the mixed and kneaded pulverulent bodies to the discharge port 14.

While the pulverulent bodies supplied continuously from the supply tube 10 in a fixed amount are spattered and dispersed with the rotary mixing disk 3 rotating with high speed in the mixing chamber 1, main liquid supplied from a pipe 23 enters a liquid chamber 24, the overflowed main liquid flows down along the overflow tube 25 of inverse conical type and a small amount of liquid such as additives is injected from the injection nozzles 4. Then, as said rotary mixing disk 3 rotates, the upper surface scraper 5 rotates to cross the injection nozzle port 4*a* while the side face scraper 7 turns so that the liquid uniformly humidifies the spattered and dispersed pulverulent bodies by the action of these scrapers in the primary grain state. The pulverulent bodies thus humidified are collected with the collecting blade 8 disposed on the bottom of the mixing chamber 3 to be sequentially supplied from a central drop port 16 into the lower stage mixing and kneading chamber 6.

In this collecting process, the pulverulent grains are humidified and swelled. In the mixing and kneading chamber 6 is rotated the rotary mixing and kneading disk 9, at high speed and the pulverulent bodies supplied from said drop port 16 are dispersed with the rotary mixing and kneading disk 9. Since the fixed and movable mixing and kneading pins 11,12 are planted respectively in the upper wall of the mixing and kneading chamber 6 and in the rotary mixing and kneading disk 9, the pulverulent bodies are securely mixing and kneaded into the thixotropic state by a passing shearing force caused by the passage of the pulverulent bodies between these pins to reach the bottom of the mixing and kneading chamber. On the bottom of the mixing and kneading chamber is rotated the mixing and kneading type scraper blade 13 to discharge the slurry of the pulverulent bodies from the discharge port 14.

The apparatus has the humidifying system and mixing and kneading system arranged in a double stage from such that the pulverulent bodies in the mixing chamber pass through the humidifying and mixing system for spattering, dispersing, humidifying, mixing and collecting to be supplied to the mixing and kneading chamber in which they pass through the mixing and kneading system to be dispersed, mixed, kneaded, scraped out and discharged. The time taken for the passage of the pulverulent bodies through the apparatus can be extended as long as possible and further the apparatus itself can be made compact. If the mixing and kneading in the mixing and kneading system is insufficient, a plurality of stages of the system may be provided, if desired.

In the continuously mixing and kneading method for preparing the slurry of pulverulent bodies such as pulverized coal, oil coke according to the present invention, the pulverulent bodies supplied continuously in a fixed amount from the supply tube 10 are spattered and dispersed by the rotary mixing disk 3 rotating with high speed in the mixing chamber 1, while the main liquid flows down as the overflow film along the overflow cone 20, and further a small amount of liquid such as additives is injected from the injection nozzle 4. Then, the upper surface scraper 5 rotates to cross the injection nozzle port 4a as said rotary mixing disk 3 rotates, while the side face scraper 7 turns so that the liquid is mixed uniformly with the spattered and dispersed pulverulent bodies by the action of these scrapers to humidify the pulverulent bodies into the primary grain state. The pulverulent bodies thus humidified are collected by the collecting blade 8 disposed on the bottom of the mixing chamber 3 to be sequentially supplied from the central drop port 16 into the lower stage mixing and kneading chamber 6 so that the pulverulent grains can be uniformly humidified and swelled in this collecting process.

The pulverulent bodies supplied from said drop port 16 into the mixing and kneading chamber 6 are dispersed by the rotary mixing and kneading disk 9, mixed and kneaded by the fixed mixing and kneading pins 11 fixed to the upper wall of the mixing and kneading chamber 6 and the movable mixing and kneading pins 12 planted in the rotary mixing and kneading disk 9 so that the pulverulent bodies can be securely mixed and kneaded into the thixotropic state by the passing shearing force produced with the passage of the pulverulent bodies between these pins to be made into a slurry, and discharged from the discharge port 14.

The continuously mixing and kneading method according to the present invention has the humidifying system and the mixing and kneading system arranged in the double stage form. The pulverulent bodies in the mixing chamber pass through the humidifying and mixing system for spattering, dispersing, humidifying, mixing and collecting to be supplied into the mixing and kneading chamber and then pass through the mixing and kneading system for dispersing, mixing, kneading, scraping and discharging. Therefore, the time taken for the passage through the apparatus can be extended as long as possible and further the apparatus itself can be made compact.

The above-mentioned and other objects and features of the invention will become apparent from the following detailed description taken in conjunction with the drawings which indicate an embodiment of the invention.

BRIEF DESCRIPTION OF THE DRAWINGS

The drawings illustrate apparatus for carrying out a continuously mixing and kneading method for preparing the slurry of pulverulent bodies such as pulverlized coal, oil coke in which.

DESCRIPTION OF THE PREFERRED EMBODIMENTS

Figure 1:
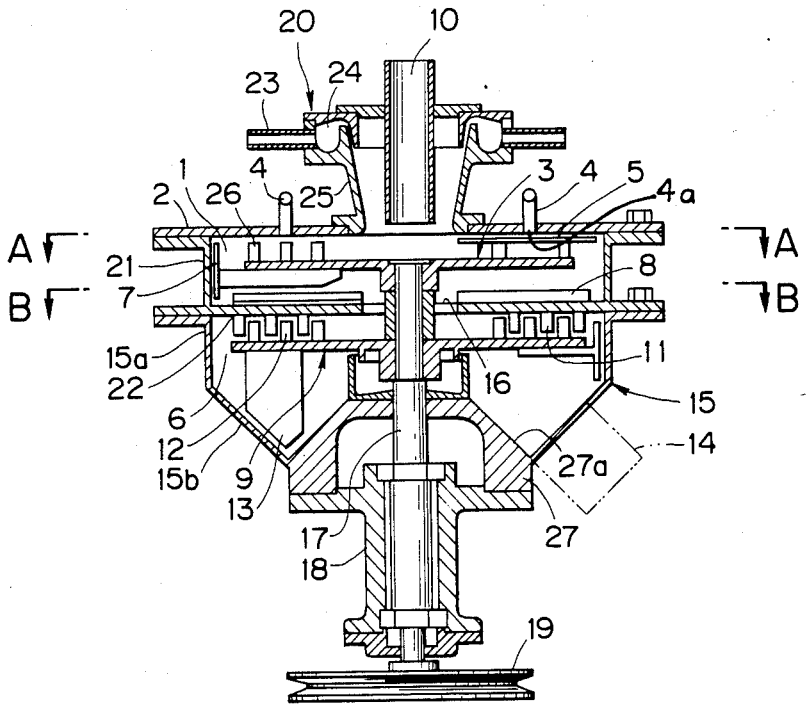
FIG. 1 is a longitudinal sectional view of the apparatus.

The mixing chamber 1 is formed in a cylinder 21 having a bottom plate 22 and covered with the base plate 2 having a circular hole 2*a* in the center. The bottom plate 22 is formed in the center with a drop port 16. On the lower stage side of said mixing chamber 1 is disposed a shell 15 consisting of a cylindrical portion 15*a* and a conical portion 15*b* connected to the lower portion thereof to thus form the mixing and kneading chamber 6 in the interior. The mixing and kneading chamber 6 is formed on one side of the lower portion with the discharge port 14. A shaft 17 supported by bearings 18 is disposed to extend through the mixing and kneading chamber 6 and the mixing chamber 1 and rotate with high speed through the direct connection to a V-pulley 19 or other drive units. In said mixing chamber 1 is disposed the rotary mixing disk 3 secured to said shaft 17 and in said mixing and kneading chamber 6 is disposed the rotary mixing and kneading disk 9 secured to said shaft 17. For example, the supply tube 10 is connected to the outlet side of the unit (not shown) developed by us for supplying continuously a fixed amount of the pulverulent bodies or the like, and the fixed amount of the pulverulent bodies are continuously sent from said unit to the center of said rotary mixing disk 3 to be spattered and dispersed by the rotary mixing disk 3. To supply main liquid to spattered and dispersed pulverulent bodies, said base plate 2 is provided on the center of the upper surface thereof with an overflow cone 20 to flow down the main liquid along an overflow tube 25 as an annular overflow film. Further, a plurality of injection nozzles 4 to jet and mix a small amount of liquid such as additives are symmetrically disposed on said base plate 2, and nozzle ports 4*a* are adjacent the mixing chamber 1. Further, an amount of humidified pulverulent bodies can be set by making the kind of liquid injected from said injection nozzle 4 the same as the main liquid according to the slurry state to be prepared, and detergent to wash the interior of the unit may be supplied from the overflow cone 20. This overflow cone 20 serves such that the main liquid supplied from a pipe 23 enters a liquid chamber 4 and the overflowed main liquid flows down as the annular overflow film along an inverse conical type overflow tube 25 and collides with the pulverulent bodies spattered and dispersed by said rotary mixing disk 3 to be uniformly mixed and humidified. A plurality of states may be of course be provided on this overflow cone 20, as shown in the Japanese patent publication No. Sho 57-9844, to thus supply and mix a plurality of kinds of main liquid.

A plurality of the upper surface scrapers 5 (three scrapers in the embodiment) are mounted radially at a same angle of circumference on said rotary mixing disk 3 to cross said injection nozzle port 4*a* as the rotary mixing disk rotates and further scrape off the pulverulent bodies which may be attached to the inner wall surface of said base plate 2. A plurality of (three in the embodiment) side face scrapers 7 are radially mounted on the peripheral side of said rotary mixing disk 3 to turn and scrape off the pulverulent bodies along the inner wall of said mixing chamber. Also, a plurality of mixing pins 26 are planted in the upper surface of the rotary mixing disk 3 to be used according to the usage.

On the bottom of said mixing chamber 1, i.e., on the upper surface of said bottom plate 22 are disposed a plurality of (three in the embodiment) L-sectioned collecting blades 8 to collect the humidified pulverulent bodies to the center so that the collected pulverulent bodies are dropped and supplied from said drop port 16 to the central portion of the mixing and kneading chamber 6. In the upper wall of said mixing and kneading chamber 6, i.e., in the lower surface of said bottom plate 22 are planted a plurality of fixed mixing and kneading pins 11, and in the upper surface of said rotary mixing and kneading disk 9 are planted a plurality of movable pins 12 at positions in which they can pass between said fixed mixing and kneading pins 11. Further, a bottom member 27 having a conical portion 27*a* is disposed on the lower portion of said conical portion 15*b*, and the bottom of said mixing and kneading chamber 6 is formed in the form of valley by said conical portions 15*b*, 27*a* while said discharge port 14 is formed in a portion of said conical portion 15*b*. The mixing and kneading type scraper blade 13 mounted on the lower surface of said rotary mixing and kneading disk 9 has the lower end shaped to correspond to the valley-like bottom of said mixing and kneading chamber 6.

Figure 2:
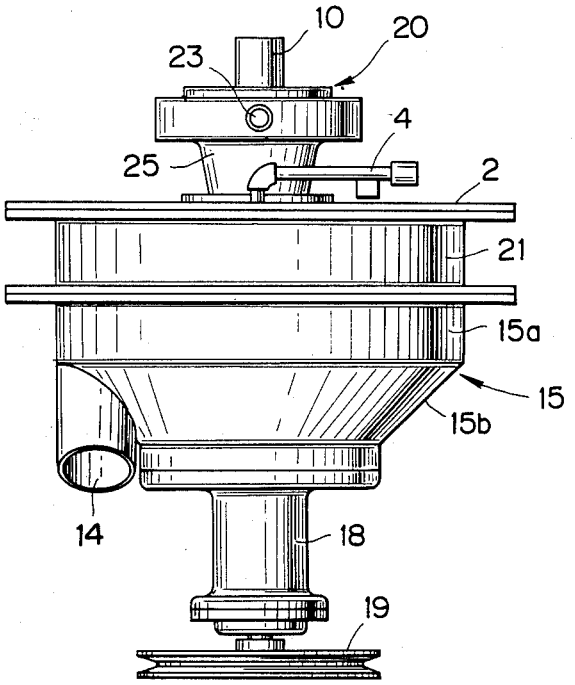
FIG. 2 is a side view of the same.
Figure 3:
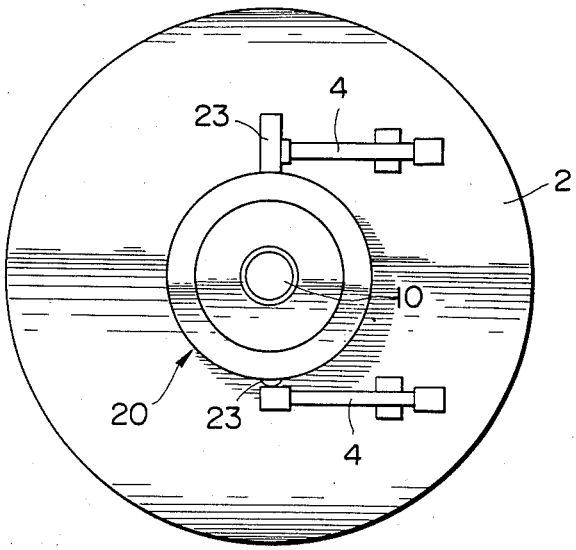
FIG. 3 is a plan view of the same.
Figure 4:
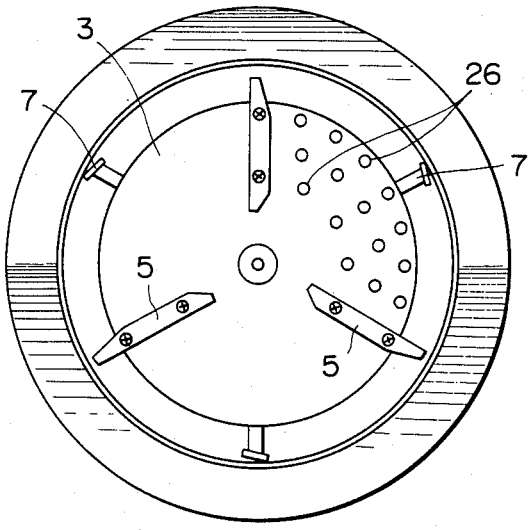
FIG. 4 is a sectional view taken along the line A—A in FIG. 1.
Figure 5:
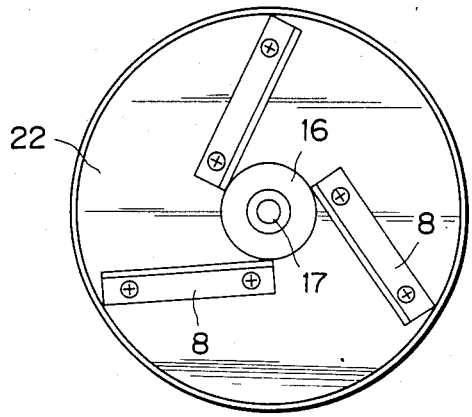
FIG. 5 is a sectional view taken along the line B—B in FIG. 1.
Figure 6:
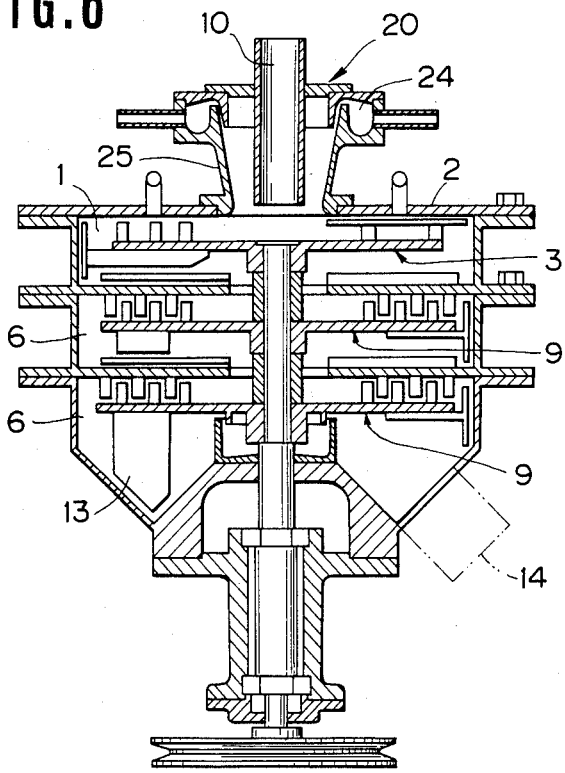
FIG. 6 is a sectional view showing another constitutional embodiment.

Further, while one stage of the mixing and kneading system is described in the constitutional example shown in FIGS. 1 and 2, multiple stages of the mixing and kneading systems, as shown in FIG. 6, may be of course provided according to the pulverulent bodies or the state of slurry to be prepared.

Next, the continuously mixing and kneading method according to the present invention will be described with reference to an operational example of the apparatus. The pulverulent bodies supplied continuously in a fixed amount, i.e., at a fixed rate from the supply tube 10 are spattered and dispersed by the rotary mixing disk 3 rotating with high speed in the mixing chamber 1. The main liquid flows down from the overflow tube 25 of the overflow cone 20 to the pulverulent bodies as an annular overflow film and collide with the pulverulent bodies to provide a uniform misture. Further, while a small amount of liquid such as additives is injected in the form of spray from the injection nozzles 4 arranged symmetrically into the mixing chanber 1, the liquid is mixed uniformly with the spattered and dispersed pulverulent bodies by the action of the upper surface scrapers 5 and the side face scrapers 7 provided on the rotary mixing disk 3 so that the pulverulent bodies are humidified in the primary grains states. The pulverulent bodies thus humidified are collected by the collecting blade 8 disposed on the bottom of the mixing chamber 3 to be sequentially supplied from the central drop port 16 into the lower stage mixing and kneading chamber 6. In this collecting process, the pulverulent grains are uniformly humidified and swelled.

The rotary mixing and kneading disk 9 is rotated with high speed in the mixing and kneading chamber 6 and the humidified pulverulent bodies supplied from said drop port 16 are dispersed centrifugally by the rotary mixing and kneading disk 9. Since the fixed mixing and kneading pins 11 and the movable mixing and kneading pins 12 are planted respectively in the upper wall of the mixing and kneading chamber 6 and in the rotary mixing and kneading disk 9, the pulverulent bodies are securely mixed and kneaded into a thixotropic state with the passing shearing force produced by the passage of the pulverulent bodies between these pins, and then reach the bottom of the mixing and kneading chamber. The mixing and kneading type scraper blade 13 is rotated on the bottom of the mixing and kneading chamber to discharge the slurry of the pulverulent bodies from the discharge port 14.

Further, said embodiment is not only applied to the preparation of a slurry of pulverulent bodies such as pulverlized coal, oil coke, but also to the humidifying, mixing and kneading of other pulverulent bodies.

What is claimed is:

1. A continuously mixing and kneading apparatus for preparing slurry of pulverulent bodies comprising:

a mixing chamber having a center axis, covered with a base plate;

a supply tube for connection to a fixed rate supply of pulverulent bodies, having an outlet opening axially into said mixing chamber through said base plate;

a rotary mixing disk rotatably disposed in the mixing chamber for rotation about said center axis to spatter and disperse the pulverulent bodies supplied thereonto from the supply tube;

an overflow tube of inverse conical type surrounding in radially outwardly spaced relation said outlet of the supply tube, said tube being disposed on an upper central portion of the mixing chamber for directing a main liquid as an annular overflow film to the spattered and dispersed pulverulent bodies on the rotary mixing disk;

a plurality of injection nozzles having outlets opening into the mixing chamber for injecting a small amount of liquid to the spattered and dispersed pulverulent bodies;

a plurality of upper surface scrapers provided on said rotary mixing disk and disposed to cross the outlet ports of said injection nozzles as the rotary mixing disk rotates so as to disperse the liquid flowing from the outlets of the nozzles;

side face scrapers provided on said rotary mixing disk to turn along the inner wall of said mixing chamber;

a collecting blade disposed on a bottom surface of said mixing chamber for collecting the pulverulent bodies to a center portion of the mixing chamber;

a mixing and kneading chamber provided below said mixing chamber;

means for directing the pulverent bodies from the center portion of the mixing chamber to a center portion of the mixing and kneading chamber;

a rotary mixing and kneading disk rotatably disposed in the mixing and kneading chamber for dispersing centrifugally the humidified pulverulent bodies supplied from said mixing chamber;

fixed mixing and kneading pins secured to an upper wall of the mixing and kneading chamber;

movable mixing and kneading pins planted in said rotary mixing and kneading disk; and a mixing and kneading type scraper blade provided on said rotary mixing and kneading disk for discharging the mixed and kneaded pulverulent bodies to a discharge port.

2. An apparatus as in claim 1, wherein the outlets of the injection nozzles are disposed radially outwardly of the overflow tube.

3. A method of continuously mixing and kneading pulverulent bodies to prepare a slurry thereof, comprising the steps of:

spattering and dispersing pulverulent bodies supplied continuously at a fixed rate from an utlet of a supply tube by a rotary mixing disk rotating axially of the outlet of the supply tube in a mixing chamber covered with a base plate;

directing a flow of a main liquid in an annular overflow film downward along an overflow tube surrounding in radially spaced relation, the outlet of the supply tube, to the spattered and dispersed pulverulent bodies;

injecting a small amount of liquid such as additives into the mixing chamber from ports of a plurality of nozzles;

uniformly humidifying the pulverulent bodies with a plurality of upper surface scrapers provided on the rotary mixing disk and disposed to cross the ports of the injection nozzles so as to disperse the liquid from the nozzles as the rotary mixing disk rotates and side face scrapers provided on the rotary mixing disk and turning along an inner wall of the mixing chamber;

collecting the humidified pulverulent bodies on a bottom surface of the mixing chamber below the rotary mixing disk, radially inwardly with a collecting blade on the bottom surface and supplying the collected humidified pulverulent bodies to a next stage mixing and kneading chamber therebelow; and dispersing centrifugally the pulverent bodies by a rotary mixing and kneading disk rotating in a mixing and kneading chamber while mixing and kneading the pulverulent bodies with fixed mixing and kneading pins disposed on an upper wall of the mixing and kneading chamber and on the rotary mixing and kneading disk, and, discharging mixed and kneaded pulverulent bodies to a discharge from the mixing and kneading chamber with a mixing and kneading type scraper blade provided on the rotary mixing and kneading disk.

4. A method as in claim 3 wherein said step of injecting comprises the step of injecting a small amount of liquid into the mixing chamber radially outwardly of the annular overflow film from the ports of the plurality of nozzles, the ports of the nozzles being disposed radially outwardly of the overflow tube.

* * * * *

UNITED STATES PATENT AND TRADEMARK OFFICE

CERTIFICATE OF CORRECTION

PATENT NO. : 4,691,867

DATED : September 8, 1987

INVENTOR(S) : Motonari Iwako and Masaaki Nakao

It is certified that error appears in the above-identified patent and that said Letters Patent is hereby corrected as shown below:

In the Heading, after line [22]: insert

--[30] Foreign Application Priority Data

Jan. 22, 1985 [JA] Japan ..... 60-8317--.

Signed and Sealed this

Twelfth Day of April, 1988

*Attest:*

DONALD J. QUIGG

*Attesting Officer*

*Commissioner of Patents and Trademarks*